US008943944B2

(12) United States Patent
Zhang et al.

(10) Patent No.: US 8,943,944 B2
(45) Date of Patent: Feb. 3, 2015

(54) STRUCTURE FOR GUNPOWDER CHARGE IN MULTI-FRAC COMPOSITE PERFORATING DEVICES

(71) Applicant: Tong Petrotech Inc, Houston, TX (US)

(72) Inventors: Guoan Zhang, Xi'an (CN); Jianlong Cheng, Xi'an (CN); Xianhong Sun, Xi'an (CN)

(73) Assignees: Tong Oil Tools Co., Ltd, Xi'an (CN); Tong Petrotech Inc, Houston, TX (US)

( * ) Notice: Subject to any disclaimer, the term of this patent is extended or adjusted under 35 U.S.C. 154(b) by 0 days.

(21) Appl. No.: 13/814,243

(22) PCT Filed: Dec. 14, 2012

(86) PCT No.: PCT/US2012/069606

§ 371 (c)(1),
(2) Date: Feb. 5, 2013

(87) PCT Pub. No.: WO2013/130166

PCT Pub. Date: Sep. 6, 2013

(65) Prior Publication Data

US 2014/0060295 A1 Mar. 6, 2014

(30) Foreign Application Priority Data

Dec. 15, 2011 (CN) ..... 2011 1 0426049

(51) Int. Cl.
*F41F 5/00* (2006.01)
*B64D 1/04* (2006.01)
(Continued)

(52) U.S. Cl.
CPC ..... *E21B 43/116* (2013.01); *E21B 43/267* (2013.01); *E21B 43/117* (2013.01)
USPC ..... 89/1.15; 175/4.55; 175/4.56; 175/4.57; 175/4.58; 175/4.59

(58) Field of Classification Search
CPC ..... F42D 1/05; F42D 1/04; F42D 1/055; F42D 3/00; F42D 1/045; F42D 1/22; F42D 1/00; F42D 1/043; F42D 1/06; F42D 5/045; F42D 1/08; F42D 1/10; F42D 3/04; F42D 1/02; F42D 5/055; F42D 3/06; F42D 5/00; F42D 1/28; F42D 5/02
USPC ..... 89/1.15; 175/4.55–4.59
See application file for complete search history.

(56) References Cited

U.S. PATENT DOCUMENTS 2,837,995 A 6/1958 Castel
2,980,017 A 4/1961 Castel
(Continued)

FOREIGN PATENT DOCUMENTS

CN 2270115 12/1997
CN 2309419 3/1999
(Continued)

OTHER PUBLICATIONS

Sep. 15, 2011 Office Action for CN 200910218911.0.
(Continued)

*Primary Examiner* — Samir Abdosh
(74) *Attorney, Agent, or Firm* — Law Offices of Albert Wai-Kit Chan, PLLC

(57) ABSTRACT

This invention provides a structure for gunpowder charge in multi-frac composite perforation devices that is easy to assemble and transport while the charge volume of gunpowder is increased. In one embodiment of the present invention, an triplet outer gunpowder box is attached onto the outer wall of the charge frame and comprises one middle gunpowder box charged with gunpowder of certain burning rate, and two side-hung gunpowder boxes charged with gunpowder of another burning rate. The two side-hung gunpowder boxes are separately located on the two sides of the middle gunpowder box and are connected with the middle gunpowder box as a unit. The middle gunpowder box is located at a position corresponding to the perforating charge, and has an inner groove for orienting the perforating charge and a through hole through which the jet flow passes.

9 Claims, 9 Drawing Sheets

(51) Int. Cl.

| | |
|---|---|
| ***E21B 43/116*** | (2006.01) |
| ***E21B 43/267*** | (2006.01) |
| ***E21B 43/117*** | (2006.01) |

(56) References Cited

U.S. PATENT DOCUMENTS

| | | | | |
|---|---|---|---|---|
| 3,620,314 | A | 11/1971 | Bohn | |
| 4,191,265 | A | 3/1980 | Bosse-Platiere | |
| 4,253,523 | A | 3/1981 | Ibsen | |
| 4,627,353 | A | 12/1986 | Chawla | |
| 4,633,951 | A | 1/1987 | Hill et al. | |
| 4,683,943 | A | 8/1987 | Hill et al. | |
| 4,760,883 | A | 8/1988 | Dunn | |
| 4,823,875 | A | 4/1989 | Hill | |
| 4,976,318 | A * | 12/1990 | Mohaupt | 166/311 |
| 5,355,802 | A | 10/1994 | Petitjean | |
| 5,775,426 | A | 7/1998 | Snider et al. | |
| 5,885,321 | A | 3/1999 | Higa et al. | |
| 6,082,450 | A | 7/2000 | Snider et al. | |
| 6,186,230 | B1 | 2/2001 | Nierode | |
| 6,439,121 | B1 | 8/2002 | Gillingham | |
| 6,497,285 | B2 | 12/2002 | Walker | |
| 6,837,310 | B2 | 1/2005 | Martin | |
| 7,216,708 | B1 | 5/2007 | Bond et al. | |
| 7,913,761 | B2 | 3/2011 | Pratt et al. | |
| 2002/0134585 | A1 | 9/2002 | Walker | |
| 2002/0189802 | A1 | 12/2002 | Tolman et al. | |
| 2003/0037692 | A1 | 2/2003 | Liu | |
| 2003/0150646 | A1 | 8/2003 | Brooks et al. | |
| 2004/0129415 | A1 | 7/2004 | Xi et al. | |
| 2004/0216866 | A1 | 11/2004 | Barlow et al. | |
| 2005/0115441 | A1 | 6/2005 | Mauldin | |
| 2005/0139352 | A1 | 6/2005 | Mauldin | |
| 2006/0118303 | A1 | 6/2006 | Schultz et al. | |
| 2009/0078420 | A1 | 3/2009 | Caminari et al. | |
| 2009/0183916 | A1 | 7/2009 | Pratt et al. | |
| 2010/0258292 | A1 | 10/2010 | Tiernan et al. | |
| 2010/0276136 | A1 | 11/2010 | Evans et al. | |
| 2011/0240311 | A1 | 10/2011 | Robison et al. | |
| 2013/0098681 | A1 | 4/2013 | Zhang et al. | |
| 2013/0145924 | A1 | 6/2013 | Zhang et al. | |
| 2013/0146287 | A1 | 6/2013 | Zhang et al. | |
| 2013/0206385 | A1 | 8/2013 | Feng et al. | |

FOREIGN PATENT DOCUMENTS

| | | | |
|---|---|---|---|
| CN | 2314091 | | 4/1999 |
| CN | 2348095 | | 11/1999 |
| CN | 2376535 | | 5/2000 |
| CN | 2386194 | | 7/2000 |
| CN | 2391987 | | 8/2000 |
| CN | 2437852 | | 7/2001 |
| CN | 1312882 | | 9/2001 |
| CN | 2453132 | | 10/2001 |
| CN | 2485421 | | 4/2002 |
| CN | 2555393 | | 6/2003 |
| CN | 1143944 | | 3/2004 |
| CN | 2611593 | | 4/2004 |
| CN | 2628724 | | 7/2004 |
| CN | 2630491 | | 8/2004 |
| CN | 2630493 | | 8/2004 |
| CN | 2653125 | | 11/2004 |
| CN | 2682199 | | 3/2005 |
| CN | 2695631 | | 4/2005 |
| CN | 2818773 | | 9/2006 |
| CN | 2818774 | | 9/2006 |
| CN | 2821154 | | 9/2006 |
| CN | 2821154 | Y | 9/2006 |
| CN | 2846740 | | 12/2006 |
| CN | 2854071 | | 1/2007 |
| CN | 1916357 | | 2/2007 |
| CN | 2866810 | | 2/2007 |
| CN | 200968200 | | 10/2007 |
| CN | 201045293 | | 4/2008 |
| CN | 100491692 | | 5/2009 |
| CN | 201358768 | | 12/2009 |
| CN | 201396090 | | 2/2010 |
| CN | 201412133 | | 2/2010 |
| CN | 201531256 | | 7/2010 |
| CN | 201568033 | | 9/2010 |
| CN | 201568038 | | 9/2010 |
| CN | 201620848 | | 11/2010 |
| CN | 101952542 | | 1/2011 |
| CN | 102031952 | | 4/2011 |
| CN | 201843593 | | 5/2011 |
| CN | 102094613 | | 6/2011 |
| CN | 201865649 | | 6/2011 |
| CN | 201884014 | | 6/2011 |
| CN | 201934084 | | 8/2011 |
| CN | 201934084 | U | 8/2011 |
| CN | 201934086 | | 8/2011 |
| CN | 201991504 | | 9/2011 |
| CN | 202055812 | | 11/2011 |
| CN | 102410006 | | 4/2012 |
| CN | 102518419 | | 6/2012 |
| CN | 1690357 | | 7/2012 |
| CN | 202391399 | | 8/2012 |
| CN | 102011561 | | 4/2013 |
| CN | 102052068 | | 4/2013 |
| CN | 102022101 | | 7/2013 |
| WO | 02/063133 | | 8/2002 |
| WO | 2011057564 | | 5/2011 |
| WO | 2011057564 | A1 | 5/2011 |
| WO | 2012088984 | | 7/2012 |
| WO | 2012088985 | | 7/2012 |
| WO | 2013090647 | | 6/2013 |
| WO | 2013123268 | | 8/2013 |
| WO | 2013130166 | | 9/2013 |

OTHER PUBLICATIONS

Mar. 5, 2012 Office Action for CN 200910218911.0.
Jul. 6, 2013 2nd Office Action for CN 201010609790.5.
Jul. 11, 2013 1st Office Action for CN 201110426049.X.
Feb. 10, 2011 International Search Report for PCT/CN2010/078601.
Mar. 15, 2012 International Search Report for PCT/CN2011/083112.
Mar. 8, 2013 International Search Report for PCT/CN2011/083113.
Aug. 6, 2013 International Search Report for PCT/US2012/069606.
Feb. 28, 2013 International Search Report for PCT/US2012/069607.
Feb. 10, 2011 Written Opinion for PCT/CN2010/078601.
Mar. 15, 2012 Written Opinion for PCT/CN2011/083112.
Mar. 8, 2013 Written Opinion for PCT/CN2011/083113.
Aug. 6, 2013 Written Opinion for PCT/US2012/069606.
Feb. 28, 2013 Written Opinion for PCT/US2012/069607.
Zhang, 2009, "Mechanism Difference and Safety Analysis of Different Composite Perforators Types", Testing of Oil and Gas Wells, vol. 18(4), pp. 59-61.
Zhao, 2007, "Efficiency Monitoring, Comparison Analysis and Optimization of Composite Perforators", Well logging technology, vol. 31(1), p. 66-71.
Zhang et al., 1986, "Preliminary study on high energy gas fracturing", Journal of Xi'an Petroleum Institute, vol. 1 (2).
Liu et al., 2006, "The discussion for a built-in composite perforator with twice synergism", Conference paper of the fifth annual conference of the perforating branch of the Professional Committee of well testing in the Chinese Petroleum Society.
Yao et al., 2006, "Experimental study on the effect of sleeve powder influenced on the perforating depth of composited perforator", Conference on new developments in perforation technology by the perforating branch of the Professional Committee of well logging in the Chinese Petroleum Society.
Feng et al., 1996, "Analysis on two-stage charge combustion characteristics and/or fracturing action procedure of multiple impulse combined perforation", Explosive Materials, vol. 75 (4), 130-133.
Zhao et al., 2005, "Research on Powder Combustion Characteristics of Various Combined Perforators", Well logging technology, vol. 30 (1) , 44-46.
Wang et al., 2002, "Situation and Tendency of Combined Perforating Techniques", Explosive materials, vol. 31 (3), 30-34.
Sun et al., 2007 "Review on combined perforation technology", Explosive materials, vol. 36 (5).

(56) References Cited

OTHER PUBLICATIONS

Feng et al., 2005, "Research on multiple-impulses composite perforating technique", Explosive materials, vol. 34 (1), 32-36.
Zhu, 1993, "Development of Foreign Petroleum Perforation Equipment", Explosive Materials, vol. 75(4).
Jan. 22, 2012 Office Action for CN 201010609790.5.
Sep. 27, 2012 Office Action for CN 200910218911.0.
Jun. 25, 2014 Office Action for U.S. Appl. No. 13/814,242.
Jul. 16, 2014 Restriction Requirement for U.S. Appl. No. 13/759,064.
Sep. 18, 2014 Office Action, U.S. Appl. No. 13/759,064.

* cited by examiner

STRUCTURE FOR GUNPOWDER CHARGE IN MULTI-FRAC COMPOSITE PERFORATING DEVICES

This application is the National Stage of International Application No. PCT/US12/69606 filed Dec. 14, 2012, which claims priority of Chinese Application CN 201110426049.X, filed Dec. 15, 2011, the entire disclosures of the preceding applications are incorporated by reference herein in its entirety.

FIELD OF THE INVENTION

The present invention relates to the field of oil exploration and exploitation, especially to a structure for gunpowder charge in multi-frac composite perforating devices.

BACKGROUND OF THE INVENTION

Currently, an integrated composite perforating gun with the gunpowder charged in the gun has been widely used in the oil field because it is simple to construct, safe and reliable, and causes less damage to the well bore. However, as the gunpowder is charged between the perforating charges in most integrated composite perforating gun, the amount of gunpowder charged is drastically decreased especially in cases where hole density is high, causing the effect to be very poor. Multi-frac composite perforating device was then developed and utilized the time difference between the pressure peak values of two types of gunpowders charged inside and outside of the charge frame of the perforating gun to extend the effective plateau pressure and enhance the efficiency of the high pressure gas and the penetrating depth of the perforating charge. However, test results showed that the duration of the effective pressure of the multi-frac composite perforating device still need further improvement. The applicant considers further increasing the charge volume of the perforating gun and the use of a combination of gunpowders to be one of the ways to overcome this problem.

SUMMARY OF THE INVENTION

The problem to be solved by the present invention is to provide a structure for gunpowder charge in multi-frac combined perforating devices, which can increase the charge volume, prolong the duration of the effective pressure and thus enhance the fracturing effect.

As the size of the perforating gun is limited, in order to increase the charge volume, one needs to make the most of the available space of the perforating gun whilst ensuring safety during transportation and usage. It is considered by the applicant that the area facing the perforating charge outside of the charge frame of the perforating gun has always been a blank area and can be used for charging gunpowder. The applicant has proved by experimentation that this charge mode is safe.

In one embodiment, the structure for gunpowder charge in a multi-frac combined perforating device comprises an inner gunpowder box inside the charge frame of the perforating gun and is located between adjacent shaped charges. In one embodiment, the present invention allows at least three types of gunpowders with different burning rates to be contained in a multi-frac composite perforating device. In one embodiment, a triplet outer gunpowder box 4 is fitted to the outer wall of a charge frame 1, said triplet outer gunpowder box 4 comprises one middle gunpowder box 3 and two side-hung gunpowder boxes 2, said side-hung gunpowder box 2 comprises gunpowder boxes 2A and 2B which are separately located on each side of the middle gunpowder box 3. Gunpowder P is charged in the middle gunpowder box 3 located outside the charge frame, gunpowder Q is charged in the inner gunpowder box located between adjacent perforating charges inside the charge frame, and gunpowder R is charged in the side-hung gunpowder box 2 located outside the charge frame. The gunpowder R comprises gunpowders R1 and R2 charged separately in the gunpowder boxes 2A and 2B, respectively. The burning rates of gunpowders R1 and R2 are not necessarily the same.

The charge frame 1 can be of several shapes; in some embodiments, the shape of the axial section of said charge frame can be cylindrical, rectangular or oval.

The middle gunpowder box 3 is connected with the two side-hung gunpowder boxes 2A and 2B to form a single unit. In one embodiment, the middle gunpowder box 3 is hinge-connected to the two side-hung gunpowder boxes 2A and 2B; in another embodiment, the boxes are connected by a flexible connector belt; in a further embodiment, the boxes are bonded together with adhesives.

In one embodiment, the middle gunpowder box 3 is located at a position corresponding to an open end of a perforating charge (i.e. the jet emitting end), and has an inner groove 32 for orienting the perforating charge and a through hole 33 through which the jet flow passes. In one embodiment, the inner groove 32 is arc-shaped and complements the shape of the perforating charge. In another embodiment, the shape of said through hole 33 can be circular, polygonal, oval or curves.

The gunpowders are divided into high burning rate gunpowder, middle burning rate gunpowder and low burning rate gunpowder based on their burning rate. The pressure-time (P-T) graphs of the three types of gunpowders are shown in FIG. 9. The peak values for each gunpowder are known as its endpoint of combustion and are shown in FIG. 9 as $t_H$, $t_M$ and $t_L$ for high burning rate gunpowder, middle burning rate gunpowder and low burning rate gunpowder respectively.

In this invention, gunpowders are graded according to the technical parameter endpoint of combustion. In one embodiment, the range of endpoint of combustion for high burning rate gunpowder, $t_H$, is about 25-80 ms; the range of endpoint of combustion for middle burning rate gunpowder, $t_M$, is about 80-280 ms; and the range of endpoint of combustion for low burning rate gunpowder, $t_L$, is about 300-800 ms.

The order to ignite the different types of gunpowder in the multi-frac composite perforating device can be optimally designed for adaptation to formations in different regions and having different reservoir characteristics. In one embodiment, the configuration of high burning rate gunpowder, middle burning rate gunpowder and low burning rate gunpowder charged in their respective gunpowder boxes can be permutated to give several tens of charge modes. In another embodiment, gunpowder P charged in the middle gunpowder box 3 outside of the charge frame is high burning rate gunpowder, gunpowder Q charged in the inner gunpowder box between adjacent perforating charges inside the charge frame is low burning rate gunpowder, and gunpowders R1 and R2 charged in the side-hung powder cases 2A and 2B outside the charge frame are middle burning rate gunpowders with the same burning rate.

The proppant may also be charged in the side-hung powder cases 2A and 2B outside the charge frame. In one embodiment, gunpowder box 2A is entirely charged with proppant, while gunpowder box 2B is entirely charged with gunpowder. In another embodiment, gunpowder box 2A is entirely charged with gunpowder, while gunpowder box 2B is only charged with proppant. In another embodiment, gunpowder box 2A are charged with both gunpowder and proppant, while gunpowder box 2B are charged with both gunpowder and proppant. In yet another embodiment, gunpowder box 2A is entirely charged with gunpowder, while both gunpowder and proppant are charged in gunpowder box 2B. During the perforation process, proppant from the side-hung gunpowder boxes can get into the formation along with the jet flow to support the crack formed and prevent the crack from closing, thus improving the seepage of the oil and gases.

In one embodiment, the triplet outer gunpowder box is attached to the outer wall of the charge frame by clamping, e.g., a claw is provided on the inside of the side-hung gunpowder boxes, and is fitted into an installation hole on the charge frame or inserted into a groove on the charge frame.

In another embodiment, the triplet outer gunpowder box is attached onto the outer wall of the charge frame by a spring jig which implements the connection to the charge frame by a matching structure of a lock hook and a lock catch, e.g., a lock hook is provided on the outer side of one of the side-hung gunpowder boxes, and a lock catch matched to the lock hook is provided on the outer side of the other side-hung gunpowder box. This structure is simpler and facilitates on site assembly.

The charge volume can be increased by using the above charge arrangement to charge gunpowder with different burning rates into the gun and achieve the aim of prolonging the acting time of the pressure. The triplet outer gunpowder box is made of materials with high resistant to both cold and heat, thereby expanding the regions and types of formations for using this product.

In one embodiment, the perforating charge is ignited by the prima cord during perforation, the product from the explosion of the perforating charge first ignites gunpowder P in the middle gunpowder box 3 of the triplet outer gunpowder box, and then ignites gunpowder Q charged in the inner gunpowder box located between adjacent perforating charges inside the charge frame, and finally ignites gunpowders R1 and R2 charged in the side-hung gunpowder boxes 2A and 2B of the triplet outer gunpowder box outside the charge frame. In one embodiment, the time difference between the pressure peaks of the middle burning rate gunpowder and the high burning rate gunpowder is about 5-10 ms, and the time difference between the pressure peaks of the low burning rate gunpowder and the middle burning rate gunpowder is about 20-50 ms. Because of the time difference between the pressure peak among gunpowder of different burning rates, energy complementation is achieved, and the duration of the effective pressure in the tunnel is longer and up to 25-60 ms, thus fully enhanced the energy utilization and extended the length of the crack. The duration of the effective pressure 25~60 ms is the sum of the 5~10 ms time difference between the pressure peaks of the middle burning rate gunpowder and the high burning rate gunpowder and the 20~50 ms time difference between the pressure peaks of the low burning rate gunpowder and the middle burning rate gunpowder.

The duration of the effective pressure can be determined after matching gunpowder P in the middle gunpowder box of the triplet outer gunpowder box, gunpowder Q in the inner gunpowder box located between adjacent perforating charges, gunpowders R1 and R2 in the side-hung gunpowder boxes 2A and 2B of the triplet outer gunpowder box with high burning rate gunpowder, middle burning rate gunpowder and low burning rate gunpowder.

As the present invention uses the triplet outer gunpowder box, there is no need to remove the positioning ring during assembly, and the three gunpowder boxes are assembled onto the charge frame simultaneously. Thus the assembly time is reduced and the assembly process is simplified. As compared to the cylindrical gunpowder boxes in the art, the triplet outer gunpowder box of the present invention occupies a smaller space and can be unfolded for easy package for transportation and storage. This drastically reduces the transport and storage cost of gunpowder. This type of structure is also easy for mass and standardized production.

LEGEND OF THE FIGURES

Figure 1:
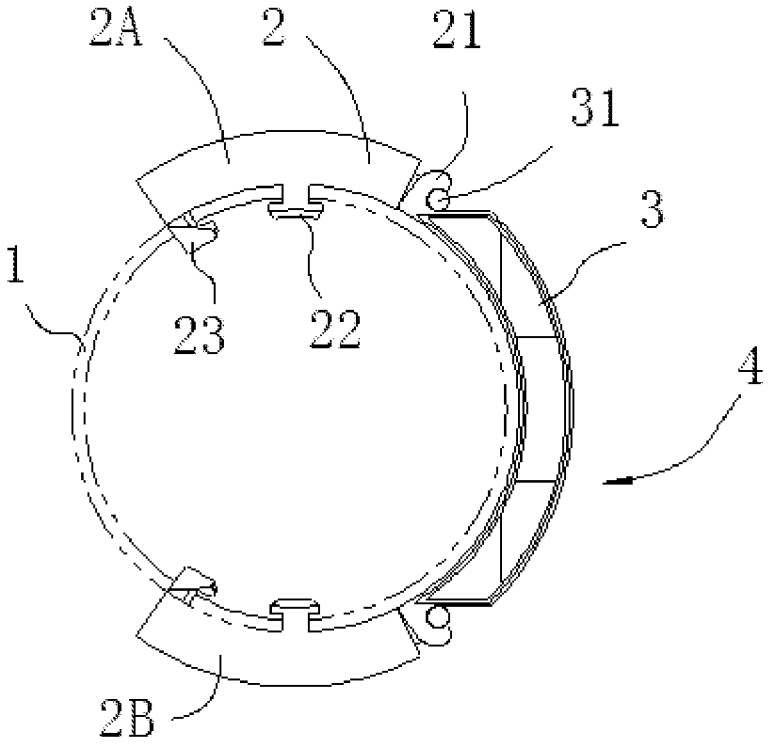
FIG. 1 shows the structure of the embodiment of the triplet outer gunpowder box as shown in Example 1.

1—charge frame, 2—side-hung gunpowder boxes (comprising parts 2A and 2B), 3—a middle gunpowder box, 4—a triplet outer gunpowder box, 21—a hinge hook, 22—a second claw, 23—a first claw, 24—a lock hook, 25—a lock catch, 31—a hinge shaft, 32—an inner groove, 33—a through hole.

DETAILED DESCRIPTION OF THE INVENTION

In one embodiment, the present invention provides a structure for gunpowder charge in multi-frac composite perforation devices having an inner gunpowder box between adjacent perforating charges in the charge frame 1 of said perforation device, said structure for gunpowder charge comprises a outer gunpowder box 4 attached to the outer wall of the charge frame 1, said outer gunpowder box 4 comprises a plurality of compartments for gunpowder, and wherein said inner gunpowder box and said outer gunpowder box 4 contain three or more gunpowders of different burning rates.

In one embodiment, the outer gunpowder box 4 comprises a middle gunpowder box 3 and two side-hung gunpowder boxes 2A and 2B wherein said boxes 2A and 2B are separately located on the two sides of said middle gunpowder box 3.

In one embodiment, the gunpowders charged in said inner gunpowder box and triplet outer gunpowder box 4 are classified into three types: high burning rate gunpowder, middle burning rate gunpowder and low burning rate gunpowder.

In one embodiment, the range for the endpoint of combustion for the high burning rate gunpowder is about 25~80 ms, the range for the endpoint of combustion for the middle burning rate gunpowder is about 80~280 ms and the range for the endpoint of combustion for the low burning rate gunpowder is about 300~800 ms.

In yet another embodiment, the time difference between the pressure peaks of the middle burning rate gunpowder and the high burning rate gunpowder is about 5~10 ms, and the time difference between the pressure peaks of the low burning rate gunpowder and the middle burning rate gunpowder is about 20~50 ms.

In one embodiment, the middle gunpowder box 3 and the two side-hung gunpowder boxes 2A and 2B are connected by a hinging mechanism, strapping with flexible belt or bonding with adhesive. One of ordinary skill in the art would readily employ any suitable hinging mechanism, flexible belt or adhesive to connect the middle gunpowder box 3 and the two side-hung gunpowder boxes 2A and 2B.

In another embodiment, the middle gunpowder box 3 is located at a position opposite to the open end (i. e. the jet emitting end) of a perforating charge.

In some embodiments, the inner side of the middle gunpowder box 3 has an inner groove 32 for orienting the perforating charge and a through hole 33 through which the jet flow passes.

In a further embodiment, the gunpowder P charged in the middle gunpowder box 3 is high burning rate gunpowder, gunpowder Q charged in said inner gunpowder box between adjacent perforating charges inside the charge frame is low burning rate gunpowder, and gunpowders R1 and R2 charged in the side-hung gunpowder boxes 2A and 2B are middle burning rate gunpowders.

In yet another embodiment, the burning rates of gunpowders R1 and R2 are the same or not the same.

In one embodiment, the side-hung gunpowder box 2A or 2B contains proppant.

In one embodiment, the triplet outer gunpowder box 4 is attached to the outer wall of the charge frame 1 by means of clamping, wherein the inner side of the side-hung gunpowder boxes 2A and 2B has claws 22 and 23 for fitting into the installation holes of charge frame 1 or inserting into the grooves of charge frame 1. Alternatively, the triplet outer gunpowder box 4 is attached to the outer wall of the charge frame 1 by means of spring jig, wherein gunpowder box 4 is attached to the outer wall of the charge frame 1 by a matching structure of a lock hook 24 and a lock catch 25.

The invention will be better understood by reference to the Experimental Details which follow, but those skilled in the art will readily appreciate that the specific examples are for illustrative purposes only and should not limit the scope of the invention which is defined by the claims which follow thereafter. It is to be noted that the transitional term "comprising", which is synonymous with "including", "containing" or "characterized by", is inclusive or open-ended and does not exclude additional, un-recited elements or method steps.

Example 1

Figure 2:
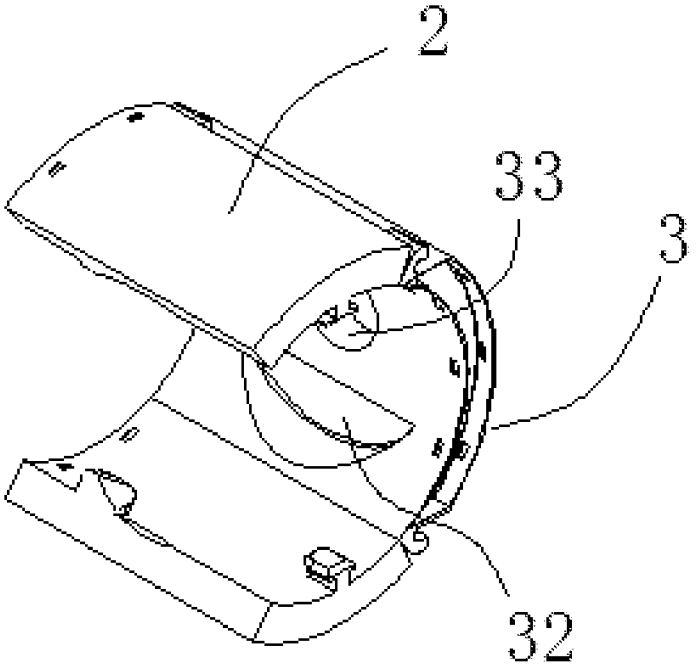
FIG. 2 shows the perspective view of the triplet outer gunpowder box from FIG. 1.

As shown in FIGS. 1 and 2, the multi-frac composite perforating device of this embodiment comprises three types of gunpowders with different burning rates, and the perforating device adopts a cylindrical charge frame. A triplet outer gunpowder box 4 is attached onto the outer wall of the cylindrical charge frame 1, and comprises a middle gunpowder box 3 and two side-hung gunpowder boxes 2A and 2B. The gunpowder P charged in the middle gunpowder box 3 outside the charge frame is high burning rate gunpowder, the gunpowder Q charged in the inner gunpowder box (not shown in the figure) between adjacent perforating charges inside the charge frame is low burning rate gunpowder and the gunpowders R1 and R2 charged in the side-hung gunpowder boxes 2A and 2B of the triplet outer gunpowder box are middle burning rate gunpowders with the same burning rate. There is no proppant charged in the side-hung gunpowder boxes 2A and 2B in this embodiment. The endpoint of combustion of the high burning rate gunpowder is 60 ms, the endpoint of combustion of the low burning rate gunpowder is 600 ms, and the endpoints of combustion of the middle burning rate gunpowders R1 and R2 are both 210 ms. The time difference between the pressure peaks of the middle burning rate gunpowder and the high burning rate gunpowder is 8 ms, and the time difference between the pressure peaks of the low burning rate gunpowder and the middle burning rate gunpowder is 25 ms.

In this embodiment, the connection between the middle gunpowder box 3 and the two side-hung gunpowder boxes 2A and 2B is achieved by a hinge joint. The hinge shafts 31 are provided on both sides of the middle gunpowder box 3, a hinge hook 21 is provided on one side of the side-hung gunpowder box 2, and the side-hung gunpowder box and the middle gunpowder box are hinged together through hinge hook 21 and hinge shafts 31. Side-hung gunpowder box 2 has claws 22, 23 on its inner side, and said claws fit into the installation holes and grooves of the cylindrical charge frame. The middle gunpowder box 3 is located at a position corresponding to the open end of a perforating charge, and has an inner groove 32 for orienting the perforating bullet and a through hole 33 through which the jet flow passes. In this embodiment, inner groove 32 is of the circular arc shape, and through hole 33 is a round hole.

Figure 3:
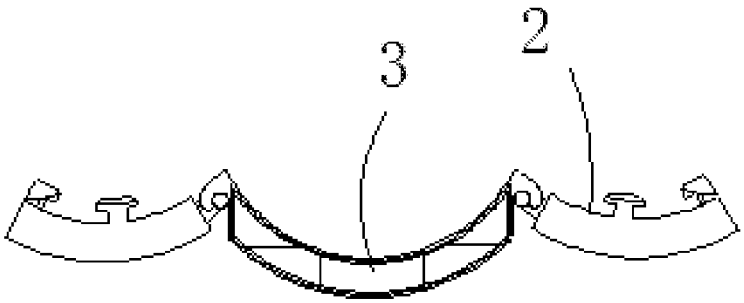
FIG. 3 shows the unfolded triplet outer gunpowder box from FIG. 1
Figure 4:
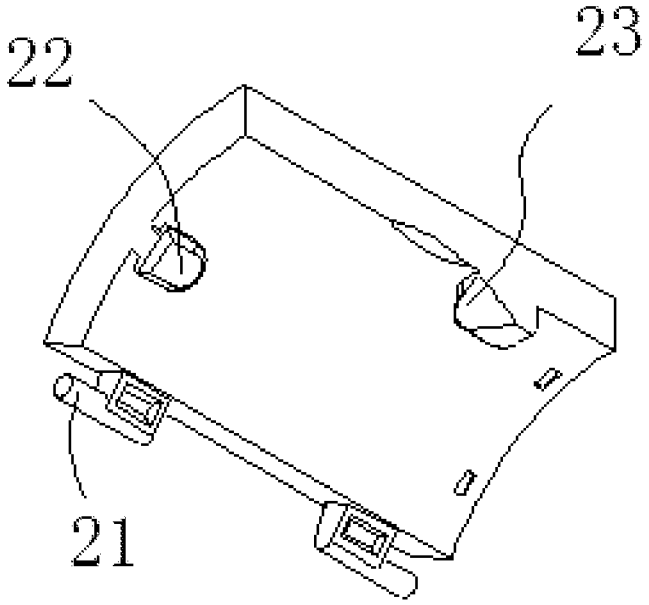
FIG. 4 shows the perspective view of the side-hung gunpowder box from FIG. 1.

FIG. 3 shows the unfolded triplet outer gunpowder box. Many triplet outer gunpowder boxes can be stacked together during packing, so that the space occupied is small and is easy to store and transport. As shown in FIG. 4, two hinge shafts 21 are provided on one sidewall of the side-hung gunpowder box for hinging with the middle gunpowder box.

Figure 5:
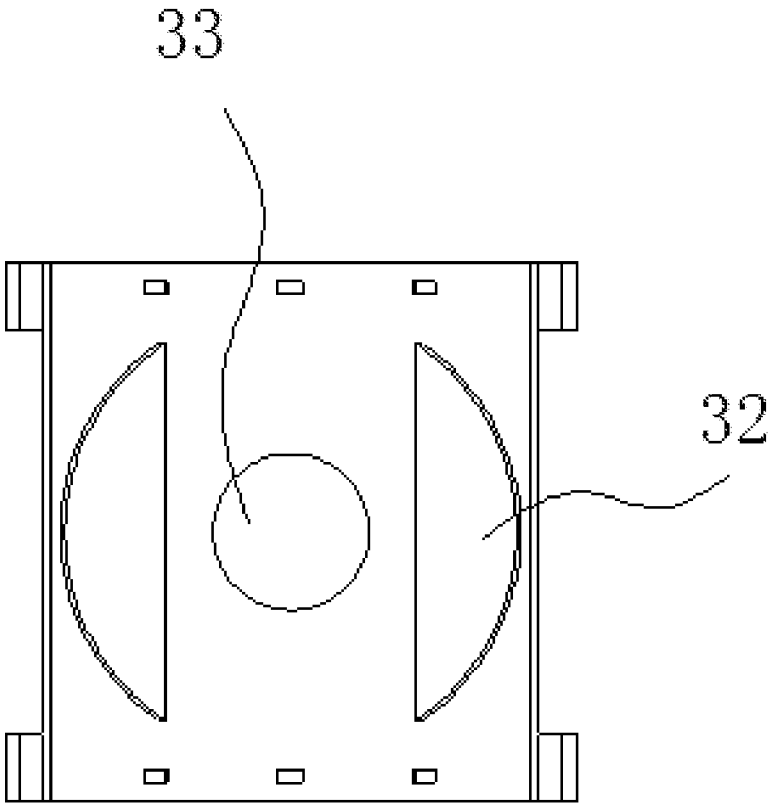
FIG. 5 shows the inner side of the middle gunpowder box from FIG. 1.
Figure 6:
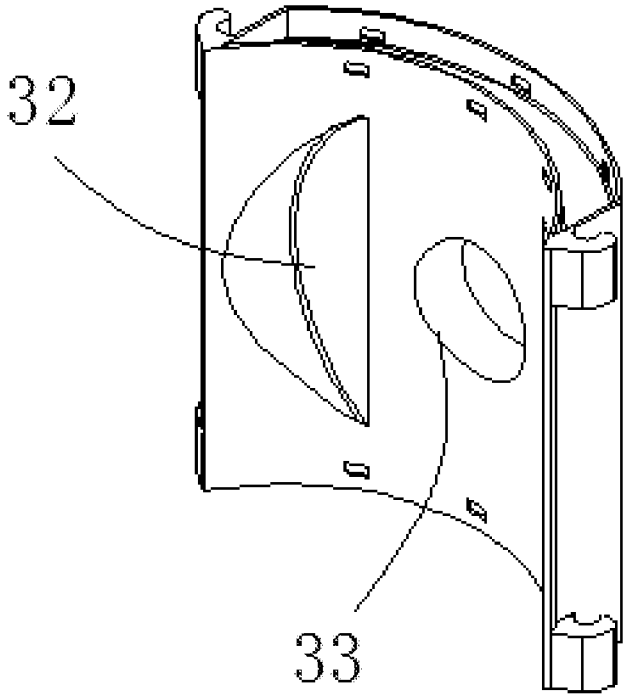
FIG. 6 shows the perspective view of the middle gunpowder box from FIG. 1.

As shown in FIGS. 5 and 6, through hole 33 is provided in the center of the middle gunpowder box 3 for the jet flow, groove 32 for orienting the perforating bullet is provided on the inner side of the middle gunpowder box 3, i. e. the open end of the perforating charge is inserted into groove 32.

In this embodiment, the side-hung gunpowder boxes 2A and 2B of the triplet outer gunpowder box 4 are attached onto the outer wall of the cylindrical charge frame 1 by clamping, e.g. first claws 23 are provided in the inner side of each of the side-hung gunpowder boxes 2A and 2B near one of their edges, and said claws is an elastic claw. A second claw 22 is provided in inner side of the side-hung gunpowder boxes 2A and 2B at the center of one of the edges; first claws 23 are fitted into the installation hole of the cylindrical charge frame while second claw 22 is inserted into the groove of the cylindrical charge frame.

When installing the triplet outer gunpowder box 4, the inner side of the outer powder case 4 is abutted to the outer surface of charge frame 1, first claws 23 of the side-hung powder cases 2A and 2B is fitted into the installation hole of the charge frame 1, and second claw 22 is aligned with the groove of the charge frame 1. The outer gunpowder box 4 is slid along the groove on the charge frame, are thus hung on the charge frame without removing the locating ring; the assembling or disassembling process is therefore simple and safe.

Example 2

Figure 7:
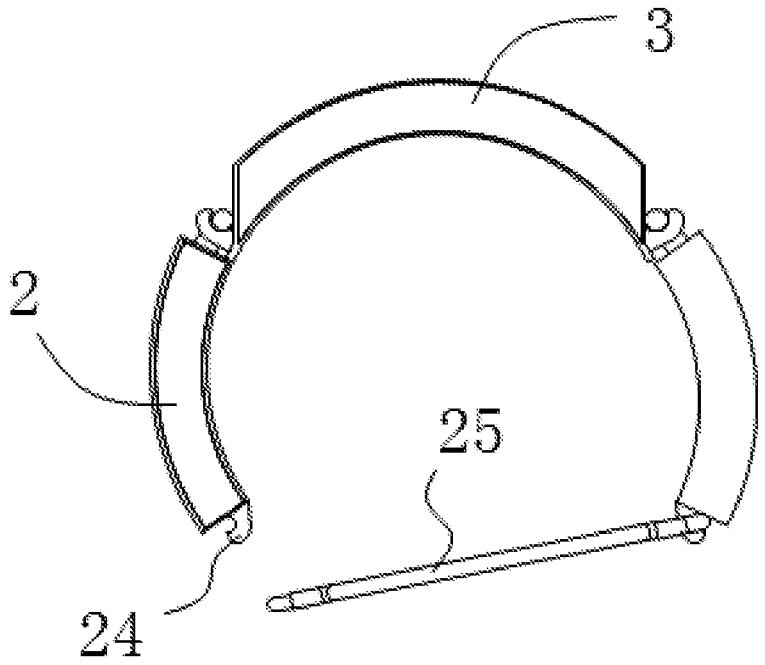
FIG. 7 shows the structure of the triplet outer gunpowder box in Example 2.
Figure 8:
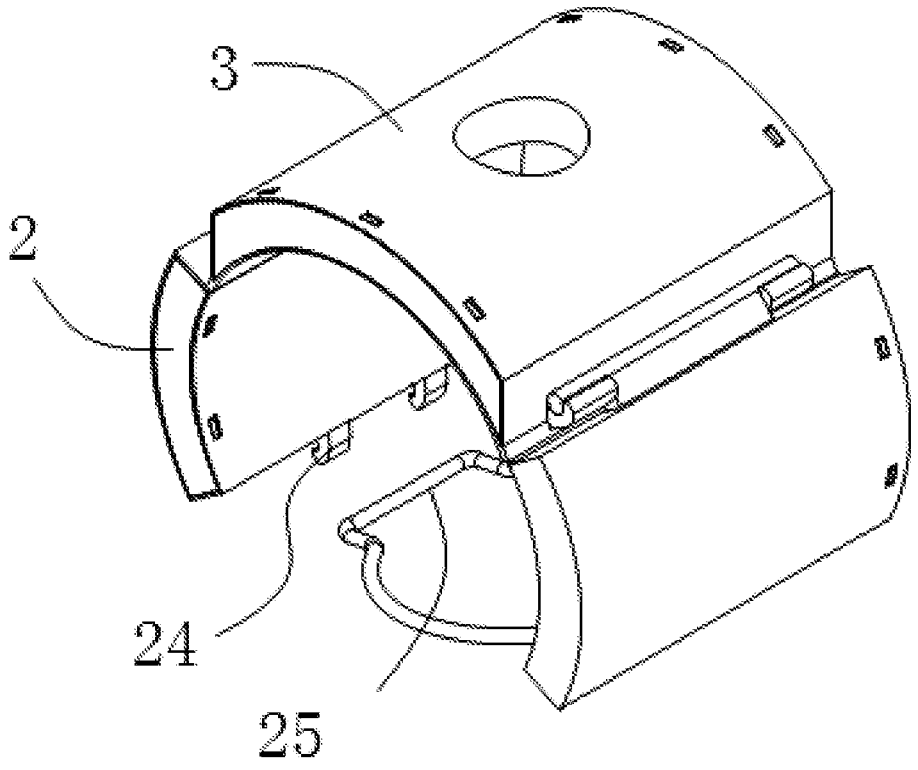
FIG. 8 shows the perspective view of the triplet outer gunpowder box in FIG. 7.
Figure 9:
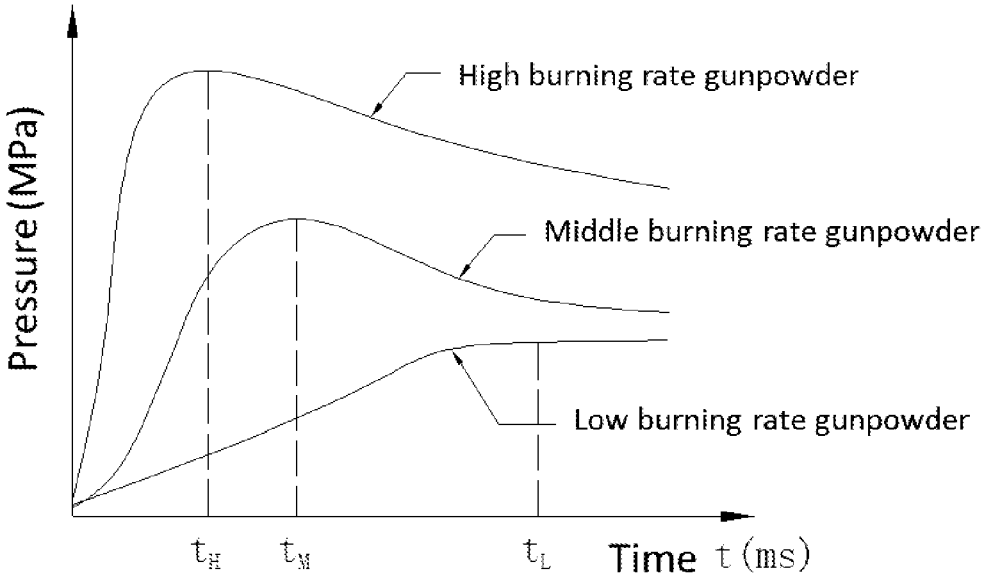
FIG. 9 shows the pressure-time (P-t) graph of the high burning rate gunpowder, the middle burning rate gunpowder, and the low burning rate gunpowder.

As shown in FIGS. 7 and 8, the side-hung gunpowder boxes 2A and 2B in the triplet outer gunpowder box 4 in this embodiment are attached onto the outer wall of the cylindrical charge frame 1 by a spring jig which implements the connection to the charge frame by the structure of a lock hook and a lock catch, e.g., two lock hooks 24 are provided on the outer edge of the side-hung gunpowder box 2A, while a lock catch 25 matching with the lock hook 24 is provided on the outer edge of the side-hung gunpowder box 2B; one end of the lock catch 25 is hinged on the outer edge of side-hung gunpowder box 2B, while the other end is free for fitting into the lock hook 24. When assembling the triplet outer gunpowder box 4, the outer gunpowder box 4 only need to be placed on the exact charge position on the charge frame 1, such that the inner side of the outer powder case 4 is abutted on the outer surface of charge frame 1, and the free end of the lock catch 25 may be locked with the lock hook 24. This type of outer gunpowder box structure is even simpler to assemble on the charge frame and conducive for on-site assembly.

The other structures and the types and parameters of the gunpowders etc in this embodiment are the same as those in Example 1.

What is claimed is:

1. A structure for gunpowder charge for a multi-frac composite perforation device that comprises an inner gunpowder box between adjacent perforating charges in the charge frame 1 of said perforation device, said structure for gunpowder charge comprises a outer gunpowder box 4 attached to the outer wall of the charge frame 1, wherein said outer gunpowder box 4 comprises a middle gunpowder box 3 and two side-hung gunpowder boxes 2A and 2B, wherein said boxes 2A and 2B are separately located on the two sides of said middle gunpowder box 3, and wherein the gunpowders charged in said inner gunpowder box and outer gunpowder box 4 are classified into three types: high burning rate gunpowder having combustion endpoint of 25~80 ms, middle burning rate gunpowder having combustion endpoint of 80~280 ms and low burning rate gunpowder having combustion endpoint of 300~800 ms.

2. The structure for gunpowder charge of claim 1, wherein the time difference between the pressure peaks of the middle burning rate gunpowder and the high burning rate gunpowder is 5~10 ms, and the time difference between the pressure peaks of the low burning rate gunpowder and the middle burning rate gunpowder is 20~50 ms.

3. The structure for gunpowder charge of claim 1, wherein the middle gunpowder box 3 and the two side-hung gunpowder boxes 2A and 2B are connected by a hinging mechanism, strapping with flexible belt or bonding with adhesive.

4. The structure for gunpowder charge of claim 1, wherein said middle gunpowder box 3 is located at a position corresponding to the open jet emitting end of a perforating charge.

5. The structure for gunpowder charge of claim 1, wherein the inner side of said middle gunpowder box 3 has an inner groove 32 for orienting the perforating charge and a through hole 33 through which the jet flow passes.

6. The structure for gunpowder charge of claim 1, wherein gunpowder P charged in said middle gunpowder box 3 is high burning rate gunpowder, gunpowder Q charged in said inner gunpowder box between adjacent perforating charges inside the charge frame is low burning rate gunpowder, and gunpowders R1 and R2 charged in the side-hung gunpowder boxes 2A and 2B are middle burning rate gunpowders.

7. The structure for gunpowder charge of claim 6, wherein the burning rates of gunpowders R1 and R2 are the same or not the same.

8. The structure for gunpowder charge of claim 1, wherein the side-hung gunpowder box 2A or 2B contains proppant.

9. The structure for gunpowder charge of claim 1, wherein the outer gunpowder box 4 is attached to the outer wall of the charge frame 1 by means of:

clamping, wherein the inner side of the side-hung gunpowder boxes 2A and 2B has claws 22 and 23 for fitting into the installation holes of charge frame 1 or inserting into the grooves of charge frame 1; or, spring jig, wherein gunpowder box 4 is attached to the outer wall of the charge frame 1 by a matching structure of a lock hook 24 and a lock catch 25.

* * * * *